United States Patent [19]

Stites

[11] 4,091,794

[45] May 30, 1978

[54] FIREPLACE HEAT EXTRACTOR

[76] Inventor: James J. Stites, 615 Hunter La., Santa Rosa, Calif. 95404

[21] Appl. No.: 744,693

[22] Filed: Nov. 24, 1976

Related U.S. Application Data

[63] Continuation-in-part of Ser. No. 597,160, Jul. 18, 1975, abandoned, which is a continuation-in-part of Ser. No. 494,027, Aug. 2, 1974, Pat. No. 3,901,212.

[51] Int. Cl.[2] ..... F24B 7/00

[52] U.S. Cl. ..... 126/121; 126/140; 126/160; 126/202

[58] Field of Search ..... 126/120, 121, 138, 140, 126/142, 164, 165, 160, 202; 237/51

[56] References Cited

U.S. PATENT DOCUMENTS

| | | | |
|---|---|---|---|
| 452,734 | 5/1891 | Russell | 126/160 X |
| 1,030,002 | 6/1912 | Livingston | 126/121 X |
| 1,488,195 | 3/1924 | Dawson | 126/121 |
| 1,747,259 | 2/1930 | Pierce | 126/121 |
| 2,161,723 | 6/1939 | Rutland | 126/121 |
| 2,743,720 | 5/1956 | Dollinger | 126/121 |
| 3,457,907 | 7/1969 | Brunig | 126/140 |
| 3,938,496 | 2/1976 | Kampf et al. | 126/121 |
| 3,976,048 | 8/1976 | Ashman, Jr. | 126/143 |
| 4,010,729 | 3/1977 | Egli | 126/121 X |

FOREIGN PATENT DOCUMENTS

| | | | |
|---|---|---|---|
| 354,485 | 10/1905 | France | 126/121 |
| 639,468 | 3/1928 | France | 126/121 |

*Primary Examiner*—William F. O'Dea
*Assistant Examiner*—Harold Joyce
*Attorney, Agent, or Firm*—Melvin R. Stidham

[57] ABSTRACT

A fireplace heat extractor comprising an air-shield, such as a glass screen, to be mounted across the fireplace opening with manually controlled, limited capacity openings therethrough that admit just enough air into the fireplace to support combustion. Baffle means prevent such air from bypassing the fire. A blower directs air through a horizontal header extending through the air-shield into place, and then through an array of tubular air ducts which extend downwardly and rearwardly from the header to function also as a fire basket. The ducts extend up along the back of the fireplace and then forwardly to open back through the air-shield into the room. Replaceable fill bars are positioned between the fire basket portion of the ducts to improve coal-supporting characteristics.

5 Claims, 5 Drawing Figures

FIREPLACE HEAT EXTRACTOR

RELATED APPLICATION

This application is a continuation-in-part of my co-pending application Ser. No. 597,160, abandoned filed July 18, 1975 for "Fireplace Heat Extractor" which in turn is a continuation-in-part of my then co-pending applicaion Ser. No. 494,027 filed Aug. 2, 1974 for "Fireplace Heat Extractor", now U.S. Pat. No. 3,901,212 granted Aug. 26, 1975.

BACKGROUND OF THE INVENTION

Conventional firplaces are notoriously inefficient as a source of heat inasmuch as a great percentage of the heat merely rises up and out of the chimney. As a result, fireplaces are provided primarily for aesthetic effect, and other heating systems are generally required. Efforts have been made to utilize the fireplace heat by heating air blow through ducts and out into the room, but such have generally detracted from the ornamental appearance of the fireplace. Moreover, the air rising in the firplace generally creates a vacuum which actually pulls the cooler air from the room, even though the air being so withdrawn may already be at a heat level which is comfortable for the room occupants.

OBJECTS OF THE INVENTION

It is an object of this invention to provide a fireplace heat extractor which may be adjusted to fit neatly and attractively within a firplace opening.

It is a further object of this invention to provide a device which functions jointly as a fire basket and as a multiple duct conduit for room-heating air.

It is a further object of this invention to provide a device for maximizing heat utilization from a fireplace by greatly restricting flow of air into the fireplace while freely expelling heated air therefrom.

It is a further object of this invention to provide a device which utilizes only enough room air to support combustion while supplementing the room air with heated air.

It is a further object of this invention to provide a fireplace heat extractor which provides maximum use of air taken into the fireplace to support combustion.

It is a further object of this invention to provide a fireplace heat extractor which makes maximum use of fuel.

It is a further object of this invention to provide a fireplace heat extractor which projects heated air into a room while isolating combustion-supporting air therefrom.

It is a further object of this invention to provide a fireplace heat extractor which utilizes the heretofore wasted heat while providing an attractive complement to the fireplace.

It is a further object of this invention to provide a fireplace heat extractor which enhances both the appearance and the heating efficiency of the fireplace.

Other objects and advantages of this invention will become apparent from the description to follow when read in conjunction with the accompanying drawings.

SUMMARY OF THE INVENTION

In carrying out this invention, I provide a relatively impervious shield, such as a "glass screen" having a front panel and side panels, which together completely enclose a fireplace opening and prevent entry of room air therein, except as needed for combustion, limited capacity dampers being provided for that purpose. Further, that air which is drawn into the fireplace is directed through the flames so as to be utilized fully. A horizontal header extends from a small blower alongside the fireplace opening, through a side panel of the air shield and then across the inside of the fireplace. An array of hot air ducts open from the header and extend downwardly and rearwardly to form a receptacle serving as a fire basket with replacable filler bars being positioned between the ducts to maximize coal retention. From the rear of the fireplace opening, the air ducts extend upwardly along the rear wall of the fireplace and then forwardly across the flue opening to open through the top portion of the air-shield. A hood is slidably carried on the forwardly extending portions of the air ducts, for adjustable positioning thereon, and means are provided to adjust the height of the header and duct array, whereby the hood may be leveled just above the fireplace opening and then positioned on the forward extensions until it is flush with the fireplace. The front panel with glass windows, and the side panels of the air-shield, are supported on the hearth and fit slidably under the hood, whereby relative thermal expansion may be accommodated. The air to be heated is drawn in by the small blower and is projected through the array of ducts out into the room. Just enough air to support combustion is allowed to be drawn from the room through the limited capacity openings in the air-shield, and virtually all of that air is directed to the combustion zone.

DESCRIPTION OF A PREFERRED EMBODIMENT

Figures 1, 2:
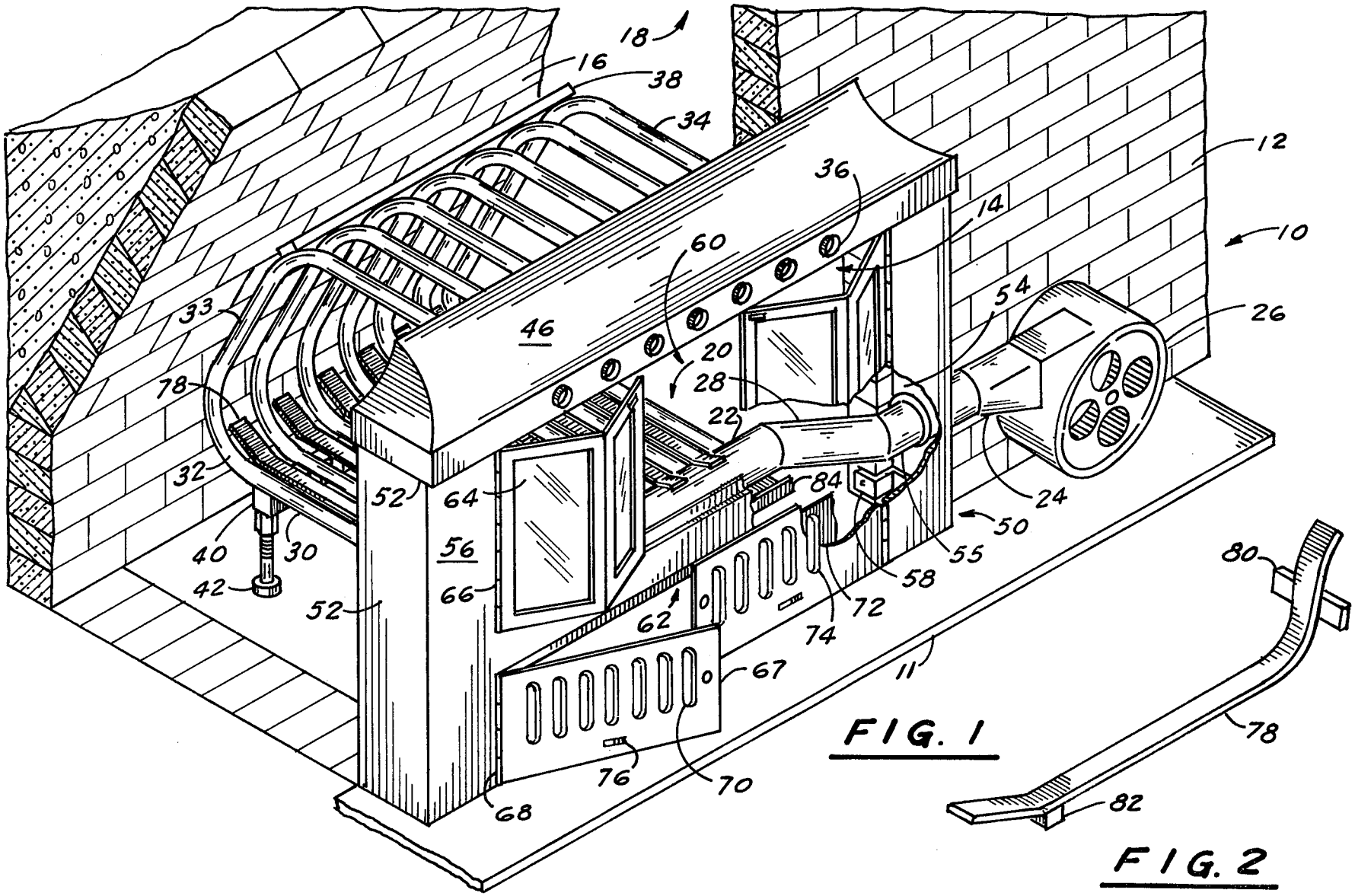
FIG. 1 is a view in perspective, partially broken away, showing a fireplace heat extractor embodying features of this invention.
FIG. 2 is a view in perspective of a filler bar to be placed between ducts.

Referring now to the drawings with greater particularity, there is shown a more or less conventional fireplace 10 including a hearth 11, a face 12 of brick, stone or the like, and opening 14 and a rear wall 16 sloping upwardly and forwardly to the flue 18, opening to the chimney.

Figure 3:
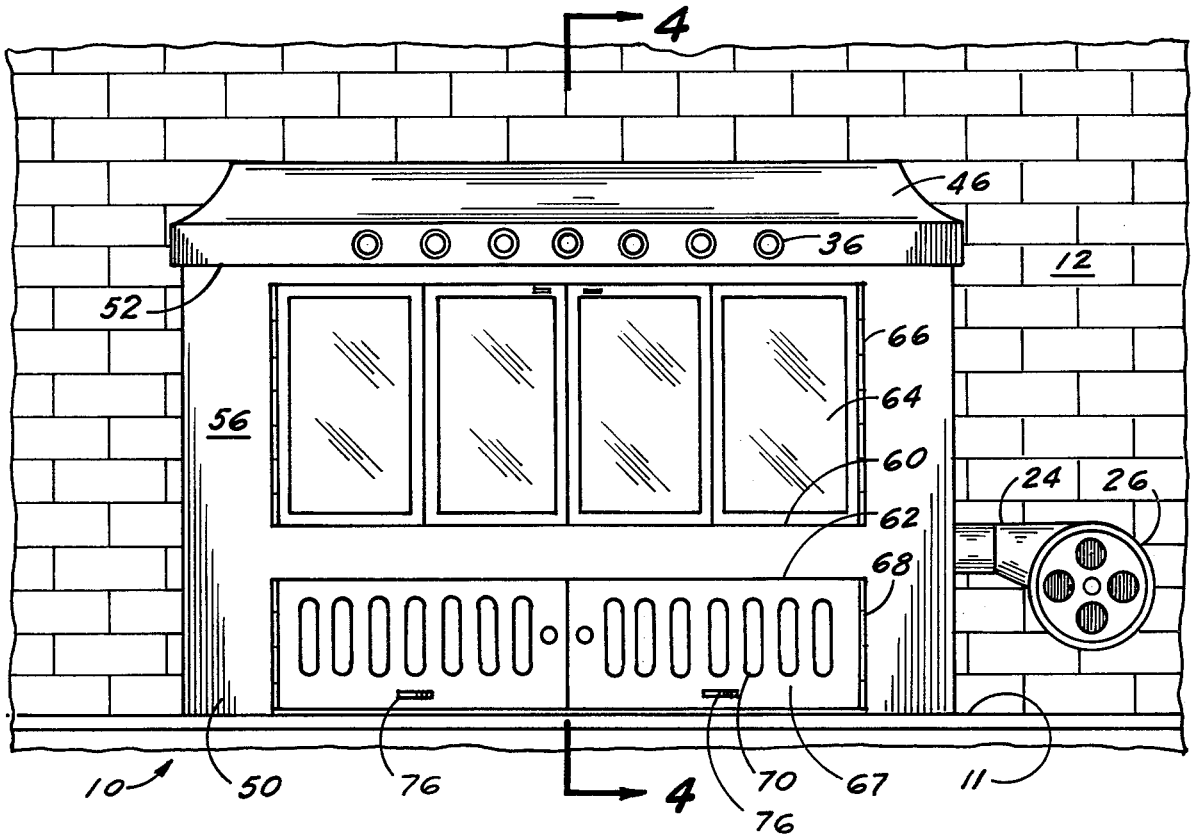
FIG. 3 is a fron elevation view showing the fireplace heat extractor in place.
Figure 4:
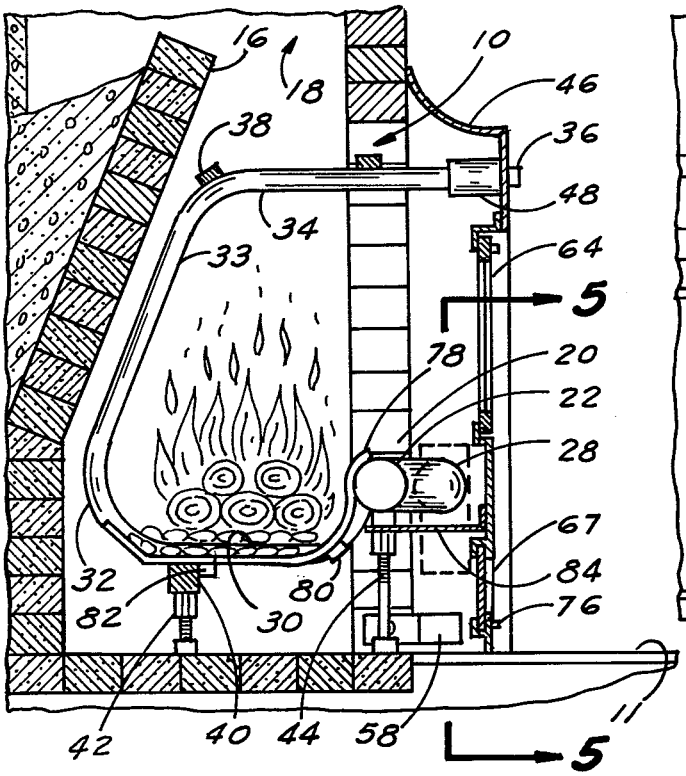
FIG. 4 is a section view taken along line 4—4 of FIG. 3.
Figure 5:
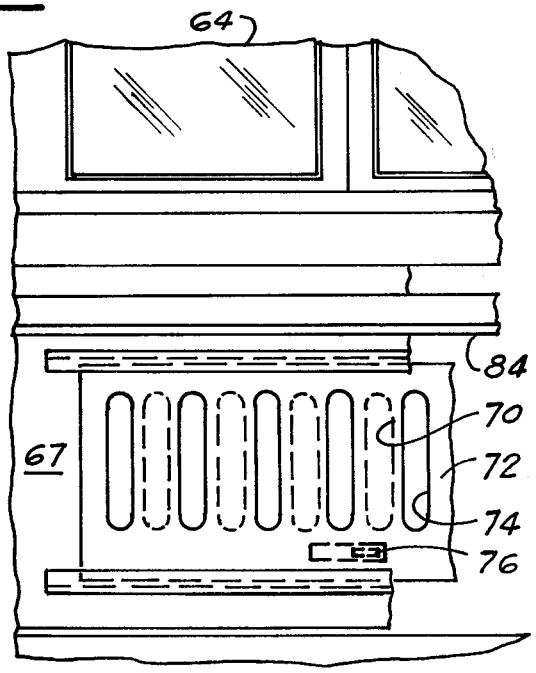
FIG. 5 is a partial section view taken along line 5—5 of FIG. 4.

The heat extractor 20 of this invention comprises a header 22 connected to the outlet duct 24 of the blower 26 by means of rearwardly directed transition pipe 28 which enables the header to be positioned well within the fireplace while the blower 26 is in front of the face 12 of the fireplace. While the header 22 is illustrated as being circular in cross-section, it is apparent that it may be rectangular, or of any other suitable configuration. Connected to open from the rear of the header is an array of tubular air ducts 30 which are formed to slope downwardly from the header (FIG. 3); and then extend in generally horizontal disposition toward the rear wall 16, where they bend upwardly at 32 to form a receptacle adapted to function as a fire basket to support fuel burning therein. The array of tubular ducts 30 extend upwardly at 33 at an angle generally parallel to the rear wall 16 of the fireplace 10 and finally terminate in forward extensions 34 which open at 36 outward of the fireplace.

The tubular ducts 30 are secured together by means of reinforcing bars 38 and 40, which unify the overall structure and add considerable rigidity thereto. Extensible legs 42 and 44 secured to cross bar 40 and the header 22, respectively, support the unified structure 20 and enable adjustment of its height and level.

The distal end of the header 22 is blanked off, whereby air drawn in by the blower 26 is directed from the header, through the air ducts 30 and out the ports 36 into the room. The ducts 30 are heated both by direct contact with the burning coals and in the forwardly extending upper portions 34, by the heat rising through the flue 18.

Preferably the total cross-sectional area of the tubular air ducts 30 is slightly greater than that of the header 22, whereby the warm air will exit from the ports efficiently and quietly without velocity-induced noise. For example, in one embodiment, I employ a header having an internal diameter of two and one half inches, delivering air to an array of seven air ducts, each with an internal diameter of one inch.

Slidably received on the upper, forwardly extending portions 34 of the air duct 30 is a hood 46, through which the upper portions 34 of the air ducts extend. Bearing sleeves 48 (FIG. 3) welded to the hood 46 are slidably and frictionally received on the upper air duct portions 34 whereby the sleeves 48 may be slidably adjusted along the portions 34.

Supported on the hearth 11 is an upright, relatively airtight enclosure 50, which is wide enough to span the fireplace opening 14 and tall enough to extend upward at 52 behind the hood 46 to form an air-shield therewith. A sliding fit enables relative thermal expansion between the hood 46 and the remainder of the air-shield 50. Sidewalls 52 and 54 fit snugly against the face 12 of the fireplace 10 and displace the front wall 56 from the fireplace opening 14. Suitable brackets 58 or the like may be employed to secure the air-shield 50 in place.

A large principal opening 60 provides access to the fire basket formed by the air ducts 30, and a smaller bottom opening 62 provides access for removal of ashes. The principal opening is normally closed by glass panel doors 64 which are hinged at 66 to the air-shield 50, and the bottom opening is normally substantially closed by vent doors 67 which may be hinged at 68 to the air-shield enclosure 50. The main doors 64 are panelled with a heat-resistant glass and, in addition, the side panels 52 and 54, extending outward from the face 12 of the fireplace, serve to displace the panels away from the maximum heat zone within the fireplace.

The outlet duct 24 from the blower 26 extends through a sleeve 55 extending through the side wall 54 and substantially sealed therewith. Hence, all air which is drawn in through the blower 26 is confined to the header 22 and ducts 30 and reenters the room through nozzles 36 free of soot, smoke and other contaminants. Moreover, the hood 46 prevents air from within the fireplace being drawn out by the aspirating effect of air exiting from the nozzles and influencing surrounding air.

The vent doors 67 have a number of vent openings, such as slots 70 which may be closed by a dampener panel 72, which is slidably carried behind the doors 67, or they may be opened to the extent that slots 74 in the panel 72 are aligned with the slots 70. Hence, with the glass panel doors 64 and the vent doors 67 closed, a very limited intake of combustion air is enabled by adjustment of the dampener panel 72 through control of a knob 76. The relatively snug fit of the air-shield enclosure 60 against the fireplace face 21 confines this combustion air to the fireplace 10 causing it to go only up the flue 18, and the air-shield prevents exit thereof through the fireplace opening 14. More significantly the air-shield admits only a limited amount of air from the room into the fireplace, i.e. just enough to support combustion. This prevents the suction of air from the room up the chimney, and allows a greater, more uniform distribution of heated air from the fireplace 10.

A plurality of replacable filler bars 78 are positioned between the lower horizontal portions of the ducts 30 whereby relatively small embers will be retained in contact with, or in proximity to, the ducts 30 with relatively fine ashes being allowed to drop through. Cross members 80 center the filler bars 78 between ducts 30, and back stops 82 seat against reinforcing bar 40 to hold the bars 78 in place. Because the filler bars are not cooled by air, as are the ducts 30, they are subject to fire damage, and are therefore, readily replacable.

Extending below the header 20 from the inner surface of the air shield 50 is a baffle plate 84, which prevents air entering through the vent opening 70 from rising up through the flue 18 before reaching the fire which is supported on the ducts 30 and filler bars 78.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. A fireplace heat extractor comprising:

an impervious air shield adapted to be supported on the hearth of a fireplace and having a flat bottom surface to engage said hearth, and having planar side and top surfaces of a size and shape to engage the face of a fireplace around the sides and top of the fireplace opening and block air movement thereinto;

limited capacity openings in the lower portion of said air shield;

manually operated damper means for said limited capacity openings;

a tubular, generally horizontal header extending through said air shield and across the lower portion of said air shield;

air intake means at an inlet end of said header, said intake means being positioned outward of said air shield;

means blocking flow out through the other end of said header;

an array of tubular ducts opening from said header and extending rearwardly therefrom to form a support for fireplace fuel and the upwardly, terminating in top portions extending forwardly through said air shield to open outwardly therefrom, so that air movement outward through said air shield confined to flow through said ducts.

2. The fireplace heat extractor defined by claim 1 wherein:

said air shield comprises:

a front panel; and side panels adapted to abut the face of a fireplace;

said header extending through one of said side panels; and a hood extending over the tops of said front and said panels;

said planar side and top surfaces being on side panels and hood, respectively.

3. The fireplace heat extractor defined by claim 2 wherein:

said top portions of the ducts extend through said hood; and said front and side panels are slidable relative to said hood.

4. The fireplace heat extractor defined by claim 1 including:

means restricting air flow from said limited capacity openings to the spaces between said tubular ducts comprising:

a baffle plate extending rearward from the inner surface of said air shield to terminate below said header.

5. The fireplace heat extractor defined by claim 1 including:

generally horizontal replacable filler members removably supported disposed between said rearward extending portions of said tubular ducts;

said filler members being slightly narrower than the spaces between ducts to allow passage of circulating air and falling of ashes.

* * * * *